US005150008A

United States Patent [19]

Lee

[11] Patent Number: 5,150,008

[45] Date of Patent: Sep. 22, 1992

[54] PLUG-IN TYPE ELECTRICAL BULB APPARATUS

[76] Inventor: Shang-Lun Lee, No. 190, Nai-Ta Road, Hsin-Chu City, Taiwan

[21] Appl. No.: 703,912

[22] Filed: May 22, 1991

[51] Int. Cl.[5] ..... H01J 5/48; H01R 33/00

[52] U.S. Cl. ..... 315/71; 315/57; 315/58; 313/318; 439/660; 439/645

[58] Field of Search ..... 315/71, 51, 52, 53, 315/200 R; 313/317, 318; 362/377, 378; 439/645, 660, 661, 642, 668, 651, 646

[56] References Cited

U.S. PATENT DOCUMENTS 4,610,497 9/1986 Tsuchida et al. ..... 439/660 X
4,623,823 11/1986 Engel ..... 439/660 X
4,629,943 12/1986 Ponce, Jr. ..... 315/71 X

*Primary Examiner*—Eugene R. Laroche
*Assistant Examiner*—Ali Neyzari
*Attorney, Agent, or Firm*—Morrison Law Firm

[57] ABSTRACT

A plug-in type AC electrical bulb apparatus comprising a bulb having being connected with elastic conductive wire extended from the tungsten and a bulb head portion having the function of voltage reduction, wherein the bulb head portion comprises a bulb seat and a copper head and a bulb recess mounted with two elastic plate corresponding to the elastic wire is provided on the seat for the adaptation of the bulb. A diode is connected in series along the conductive wire for the prevention of short circuit such that the high voltage from an alternating current source is reduced to direct current 55 V.

1 Claim, 4 Drawing Sheets

PLUG-IN TYPE ELECTRICAL BULB APPARATUS

BACKGROUND OF THE PRESENT INVENTION

The present invention relates to a plug-in type electrical bulb apparatus, in particular, to a plug-in type of alternating current (AC) 110 V electrical bulb apparatus which essentially comprises a bulb socket and a copper head. The electrical bulb apparatus is especially suitable for small size lighting bulbs or lighting equipments, and provides a convenient, safety and longevity in lighting equipment.

Conventionally, the type of bulb which known as "C7 bulb" is used in outdoor lighting or as indoor lighting bulb. The base of the bulb is provided with a copper head portion joined together with glass, and connected to the electrode of an AC 110 V source. After long time of utilization, the extreme heat produced by the bulb may damaged the copper head portion, and the copper head portion may separated from the glass. At a result, the electrode of the bulb may cause short circuit and endanger the lighting equipment or environment. Owing to the fact that the size of the C7 electrical bulb is comparatively large, the energy consumption is also comparatively large, the energy consumption is also comparatively large. Besides, the C7 electrical bulb occupies greater space of installation.

SUMMARY OF THE INVENTION

Accordingly, it is an object of the present invention to provide a AC, 110 V plug-in electrical bulb apparatus which mitigates the above drawbacks.

It is another object of the present invention to provide a AC, 110 V plug-in type electrical bulb apparatus in which the main body of the bulb is divided into a bulb portion is provided with two elastic conductive wire extended from the tungsten of the bulb to the external thereof. The end portion is formed into a plug-in terminal. At the bulb head portion, a bulb recess corresponding to the shape of the bulb plug-in terminal is formed for the plug in of the bulb. Thus, the bulb apparatus in accordance with the present invention provides a very convenient installation to a lighting equipment.

It is yet another object of the present invention to provide a plug-in type electrical bulb apparatus, wherein the bulb recess for the adaptation of bulb is provided with a pair of elastic plate corresponding to the position of two elastic conductive wire, such that the plug in of the bulb will provide electrical conduction through contacting between the elastic plate and the conductive wire. In addition, a further two elastic plates are respectively provided with a conductive plate and a conductive wire, wherein a diode is mounted in series along the conductive wire such that the combination of bulb base and the copper head provides the conduction of current. At the same time, the voltage of the AC current is lowered by means of the diode and the voltage of the AC current is lowered by means of the diode and the voltage arrives at the elastic plate is a DC of 5 V which is suitable for small light bulbs.

Still another object of the present invention is to provide a plug-in type electrical bulb apparatus which elminates short circuit. That is, the diode only allow a small amount of current to pass through. If short circuit is occurred, the large amount of current will burn the diode and thus the circuit is opened.

It is yet another object of the present invention to provide a plug-in electrical bulb apparatus which has a small size, lower electrical energy consumption, and short circuit prevention.

It is still another object of the present invention to provide a plug-in electrical bulb apparatus which can be used either at outdoor or indoor, and can also be easily assemble and disassemble.

The foregoing and other objects, features and advantages of the present invention will be apparent from the following description of a preferred embodiment of the invention as illustrated in the accompanying drawings.

BRIEF DESCRIPTION OF THE DRAWINGS

The present invention will be further explained with reference to the annexed drawings, wherein.

DETAILED DESCRIPTION OF THE INVENTION

While this specification concludes with claims particularly pointing out and distinctly claiming that which is considered to be the invention, it is believed that the invention can be better understood from a reading of the following detailed description of the invention.

Figure 1:
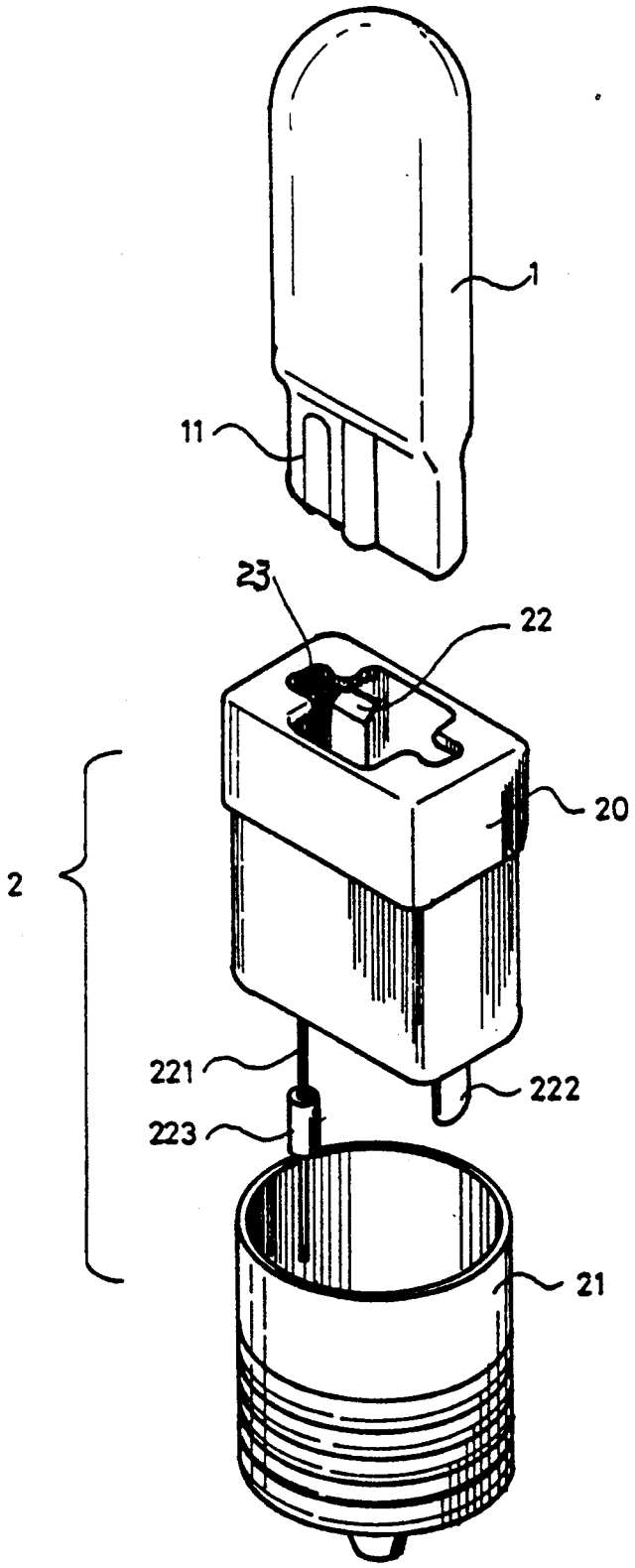
FIG. 1 is a perspective exploded view of the electrical bulb apparatus in accordance with the present invention.
Figure 2:
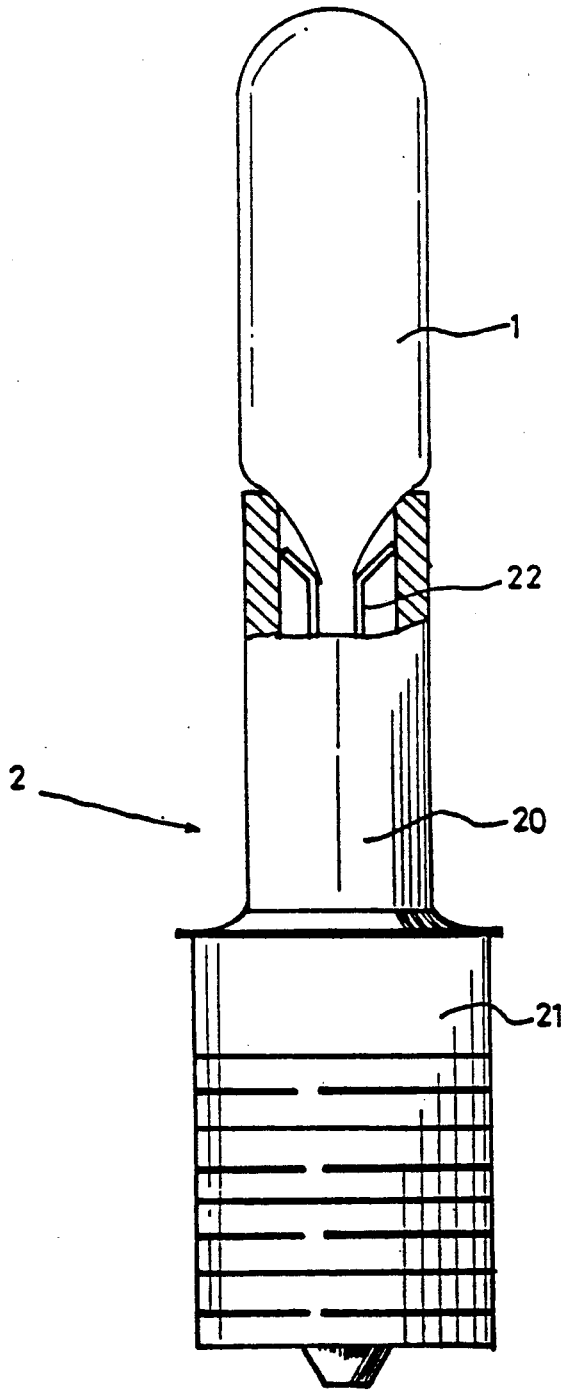
FIG. 2 is a partial cross section view showing the plugged in of the bulb and with contact with the elastic plate in accordance with the present invention.
Figure 3:
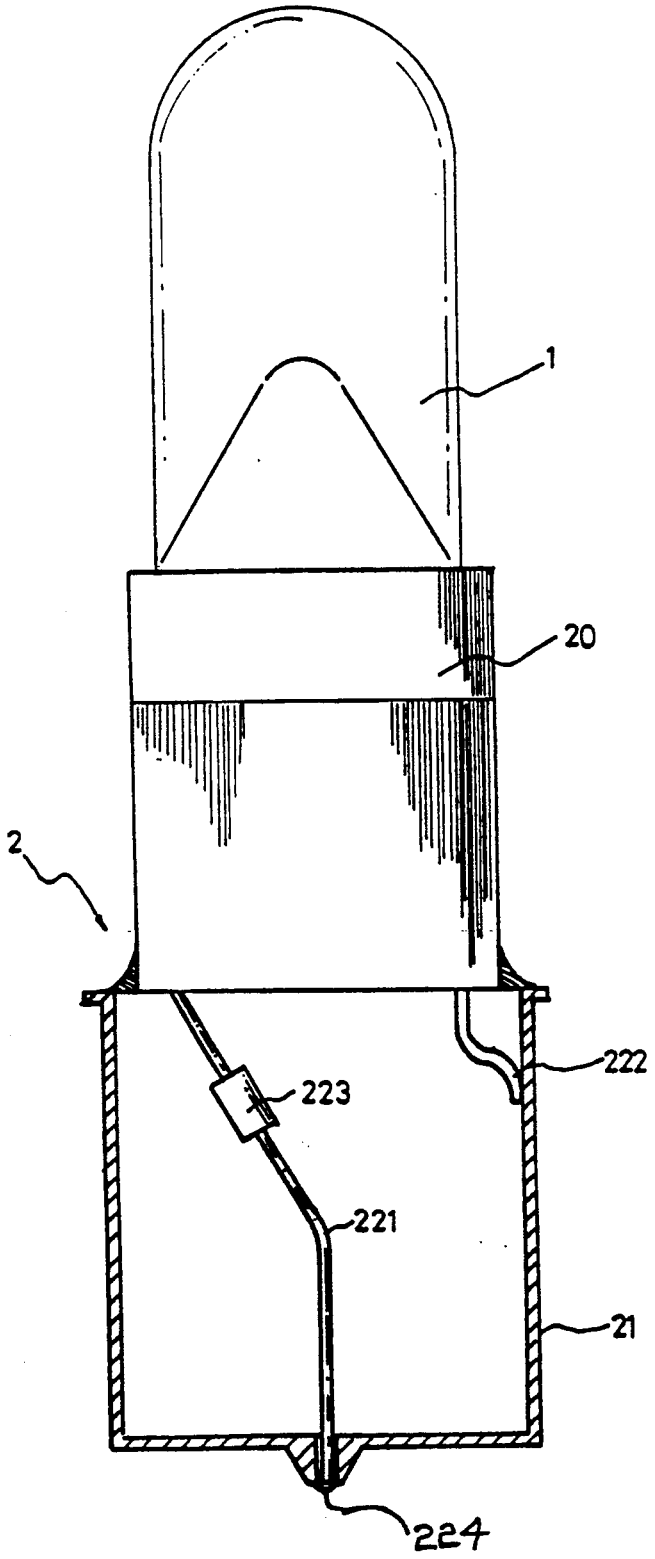
FIG. 3 is another partial cross section view, showing the combination of bulb seat and the copper head, and the contact of conductive wire and conductive plate being in contact with the electrodes, in accordance with the present invention.
Figure 4:
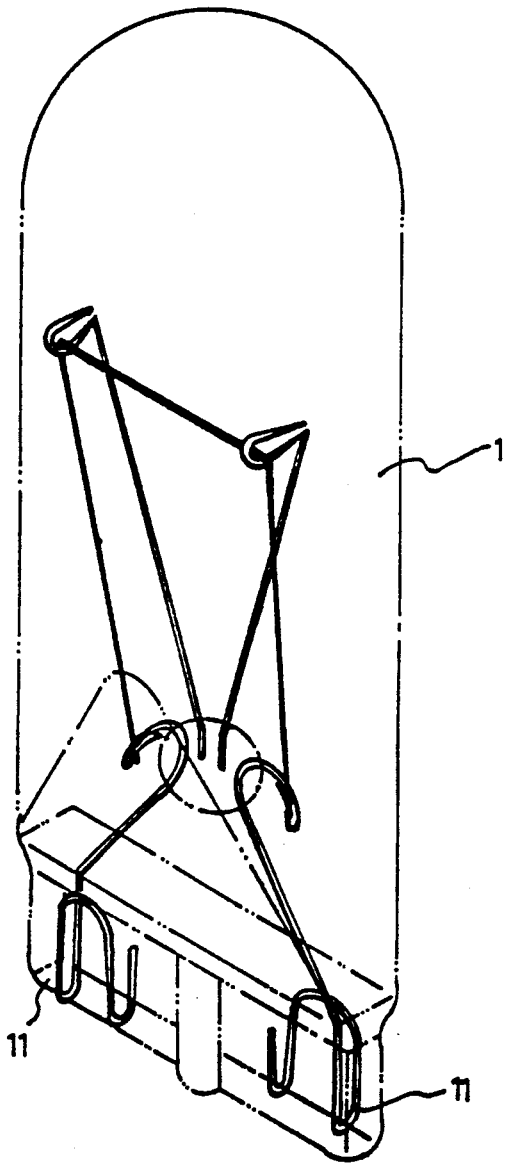
FIG. 4 is an enlarged view of the electrical bulb, showing the elastic conductive wire provided at the plug-in terminal, in accordance with the present invention.

Referring to the figures, in particular, to FIG. 1, and electrical bulb 1 and a bulb head portion 2 are shown. In accordance with the present invention, one end of the bulb 1 is provided with two elastic conductive wires 11 extended from the tungsten of the bulb 1 to the external thereof. The two elastic conductive wires 11 are corresponding to each other, which can be seen in FIG. 4. The end terminal of the bulb having the conductive wire 11 is the plug-in end of the bulb 1. The bulb head portion 2 comprises a bulb seat 20 and a copper head 21 portion, wherein a bulb recess 23 corresponding to the shape of the plug-in terminal of the bulb 1 is provided at the bulb seat 20 such that the bulb 1 can be plugged therein. In addition, the bulb seat 20 for the adaptation of bulb 1 is provided with a pair of elastic plate 22 corresponding to the position of two elastic conductive wire 11 at the end terminal of the bulb 1, such that the plug in of the bulb 1 will provide electrical conduction by means of contact between the elastic plate 22 and the conductive wire 11 (as shown in FIG. 2). Along the lower end of the elastic plate 22, a shorter conductive plate 222 and a longer conductive wire 221 are respectively mounted. On the conductive wire 221, a diode 223 is connected to a center terminal 224. Conductive plate 222 is connected to the inside of copper heat portion 21. The function of the conductive plate 222 and the conductive wire 221 is used to provide conduction (as a positive and negative electrode) after the connection of the bulb seat 20 and the copper head 21, as shown in FIG. 3. The diode 223 connected in series on the conductive wire 221 has a function of short circuit prevention and also voltage reduction. That is, the AC 110 V from the copper head portion 21 is converted to the direct current 55 V (DC) through the diode. The converted DC voltage is suitable for use in smaller light bulb. At the same time, larger electrical current passed through the diode 223 will destroyed the diode. As a result, the excess of the voltage will cause the circuit to open and to cut off the supply of the AC. Thus, the electrical bulb apparatus in accordance with the present invention provides a very safe application to the user.

Accordingly, while the invention has been particularly shown and described with reference to a preferred embodiment thereof, it will be understood by those skilled in the art that various changes in form and detail may be made therein without departing from the spirit and scope of the invention.

I claim:

1. An alternating current electrical bulb apparatus comprising:

a bulb having a filament sealed therein and a plug-in end having first and second elastic conductive wires extending from the filament through said plug-in end;

a head portion including a bulb seat and a metal head, said bulb seat including a recess adapted to receive said plug-in end of said bulb;

said metal head including a head portion and a center terminal, generally centered in said head portion;

said bulb seat and said metal head being rigidly affixed to each other;

first and second elastic plates disposed within said recess in said bulb seat for electrically contacting said first and second conductive wires on said plug-in end of said bulb;

a third conductive wire and a third conductive plate disposed in said head portion and engageable with said pair of elastic plates;

said third conductive plate providing an electrical connection between said bulb seat and said metal head;

said third conductive wire being connected from said second conductive plate to said center terminal;

a diode connected in series with said third conductive wire such that said alternating current supplied to said electrical bulb apparatus is converted to a direct current of a lower voltage between said first and second elastic plates.

* * * * *